US006013143A

United States Patent [19]

Thompson

[11] Patent Number: 6,013,143

[45] Date of Patent: Jan. 11, 2000

[54] TERTIARY AMINE AZIDES IN HYPERGOLIC LIQUID OR GEL FUELS PROPELLANT SYSTEMS

[75] Inventor: Darren M. Thompson, Madison, Ala.

[73] Assignee: The United States of America as represented by the Secretary of the Army, Washington, D.C.

[21] Appl. No.: 09/062,989

[22] Filed: Apr. 20, 1998

[51] Int. Cl.[7] ..... C06B 47/00

[52] U.S. Cl. ..... 149/1; 149/17; 149/45; 149/74; 149/109.4; 60/211

[58] Field of Search ..... 60/211; 149/74, 149/17, 1, 45, 109.4

[56] References Cited

U.S. PATENT DOCUMENTS

| | | | |
|---|---|---|---|
| 4,012,384 | 3/1977 | Nielsen | 149/122 |
| 4,499,723 | 2/1985 | Frankel et al. | 60/211 |
| 5,133,183 | 7/1992 | Asaoka et al. | 60/204 |
| 5,152,136 | 10/1992 | Chew et al. | 60/251 |
| 5,621,156 | 4/1997 | Thompson | 60/211 |

OTHER PUBLICATIONS

Golding et al., *Chem. Abs.*, 107, ab #(97467) ind. Reg. No. 98137–85–0, 1987.

Lei et al., *Chem. Abs.*, 117, ab. # 26660 ind. Reg. No. 86147–04–8, 1992.

*Primary Examiner*—Edward A. Miller

*Attorney, Agent, or Firm*—Arthur H. Tischer; Freddie M. Bush

[57] ABSTRACT

Inhibited Red Fuming Nitric Acid (IRFNA) type IIIB and monomethyl hydrazine (MMH) ignite when contacted with each other because of a hypergolic chemical reaction and are the preferred oxidizer and fuel for bipropellant rocket propulsion systems. These propellants can deliver a specific impulse of 284 lbf sec/Ibm and density impulse of 13.36 lbf sec/cubic inch when the engine operating pressure is 2000 psi. Special precautions must be used when handling because of its toxic properties. A fuel gel propellant fuel that would be a suitable replacement for MMH must be less toxic and have a competitive density impulse for the same engine operating conditions. Three compounds meeting the specified requirements have been synthesized and their physical and ballistic properties are evaluated herein as shown in Table 1. The chemical names for these compounds are dimethylaminoethylazide (DMAZ), pyrollidinylethylazide (PYAZ), and bis (ethyl azide)methylamine (BAZ). DMAZ under the same operating conditions can deliver a specific impulse of 287 lbf sec/Ibm and a density impulse of 13.8 lbf sec/cubic inch.

5 Claims, 2 Drawing Sheets

TERTIARY AMINE AZIDES IN HYPERGOLIC LIQUID OR GEL FUELS PROPELLANT SYSTEMS

BACKGROUND OF THE INVENTION

A liquid or gel bipropellant rocket propulsion system consists of gas generators, oxidizer and fuel propellant tanks, plumbing, oxidizer and fuel valves, and an engine. This propulsion unit begins operation when the gas generators have been initiated and the gases from the gas generator pressurize oxidizer and fuel propellant tanks. When the oxidizer and fuel valves open, the pressurized oxidizer and fuel tanks then force the propellants through the plumbing into the engine where the propellants are mixed and ignited. The propellants can be ignited by either ignition aids or by hypergolic chemical reaction. Ignition aids can take up valuable space in the propulsion system so a hypergolic chemical reaction is the preferred ignition method. Inhibited Red Fuming Nitric Acid (IRFNA) type IIIB and monomethyl hydrazine (MMH) ignite when contacted with each other because of a hypergolic chemical reaction and are the preferred oxidizer and fuel for bipropellant rocket propulsion systems. These propellants can deliver a specific impulse of 284 lbf sec/lbm and density impulse of 13.36 lbf sec/cubic inch when the engine operating pressure is 2000 psi. Special precautions must be used when handling because of its toxic properties.

If a liquid gas generator is used excess pressurizing gases do not have to be dumped overboard to prevent overpressurization that can result from a solid gas generator formulation. A solid gas generator formulation once ignited cannot be stopped; however, a liquid gas generator system supplies gas pressure only when it is needed. Hydrazine and hydrazine blends have considered for liquid gas generators because of their ability to decompose at ambient conditions on an iridium catalyst to form warm (100° F. to 1500° F.) gases. Hydrazine is undesirable because of its toxicity and high melting point (34° F.).

An object of this invention is to provide a less toxic hypergolic fuel gel propellant that is a suitable replacement for MMH.

Another object of this invention is to provide a less toxic hypergolic fuel gel propellant that is a suitable replacement for MMH which has a competitive density impulse for the same engine operating conditions.

A further object of this invention is to provide alternative fuels selected from tertiary amine azides that can function as hypergolic fuels in a bipropellant propulsion system that meet the above conditions as further defined hereinbelow.

SUMMARY OF THE INVENTION

The tertiary amine azides which are defined below are non-carcinogenic alternative to MMH in hypergolic bipropellant propulsion systems. Calorimetry methods have been used to determine the heat of formation of these compounds since this information has not been published in the open literature. The heat of formation data has been used to determine the specific impulse and density impulse of the respective formulations. A tertiary amine typically has three hydrocarbon moeities attached to the nitrogen atom. The tertiary amine azides of this invention can have no more than seven carbon atoms in the molecule for the compound to remain hypergolic.

Further, these tertiary amine azides can contain only two azide moeities which are attached at the oposite end of the hydrocarbon portions from the amine nitrogen atom. A special case that still meets these requirements is a pyrollidine moeity (a five atom cyclic structure wherein each end of a linear four carbon atom structure is attached to a common nitrogen atom), and the common nitrogen atom has an attached ethyl azide moeity.

Three compounds meeting the specified requirements have been synthesized and their physical and ballistic properties are evaluated herein as shown in Table 1. The chemical names for these compounds are dimethylaminoethylazide (DMAZ), pyrollidinylethylazide (PYAZ), and bis (ethyl azide)methylamine (BAZ). The structural formulae for these compounds are defined hereinbelow.

Dimethylarninoethylazide (DMAZ) has the following structure:

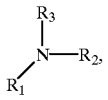

,wherein $R_1$=—$CH_3$, $R_2$=–$CH_3$, $R_3$=—$CH_2CH_2N_3$ Bis (ethylazide)methylamine (BAZ) has the following structure:

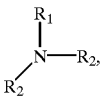

,wherein $R_1$ and $R_2$ are as previously defined.

Pyrollidinylethylazide (PYAZ) has the following structure:

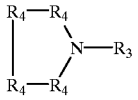

previously defined and wherein $R_4$ is —$CH_2$

DESCRIPTION OF THE PREFERRED EMBODIMENT(S)

Figure 1:
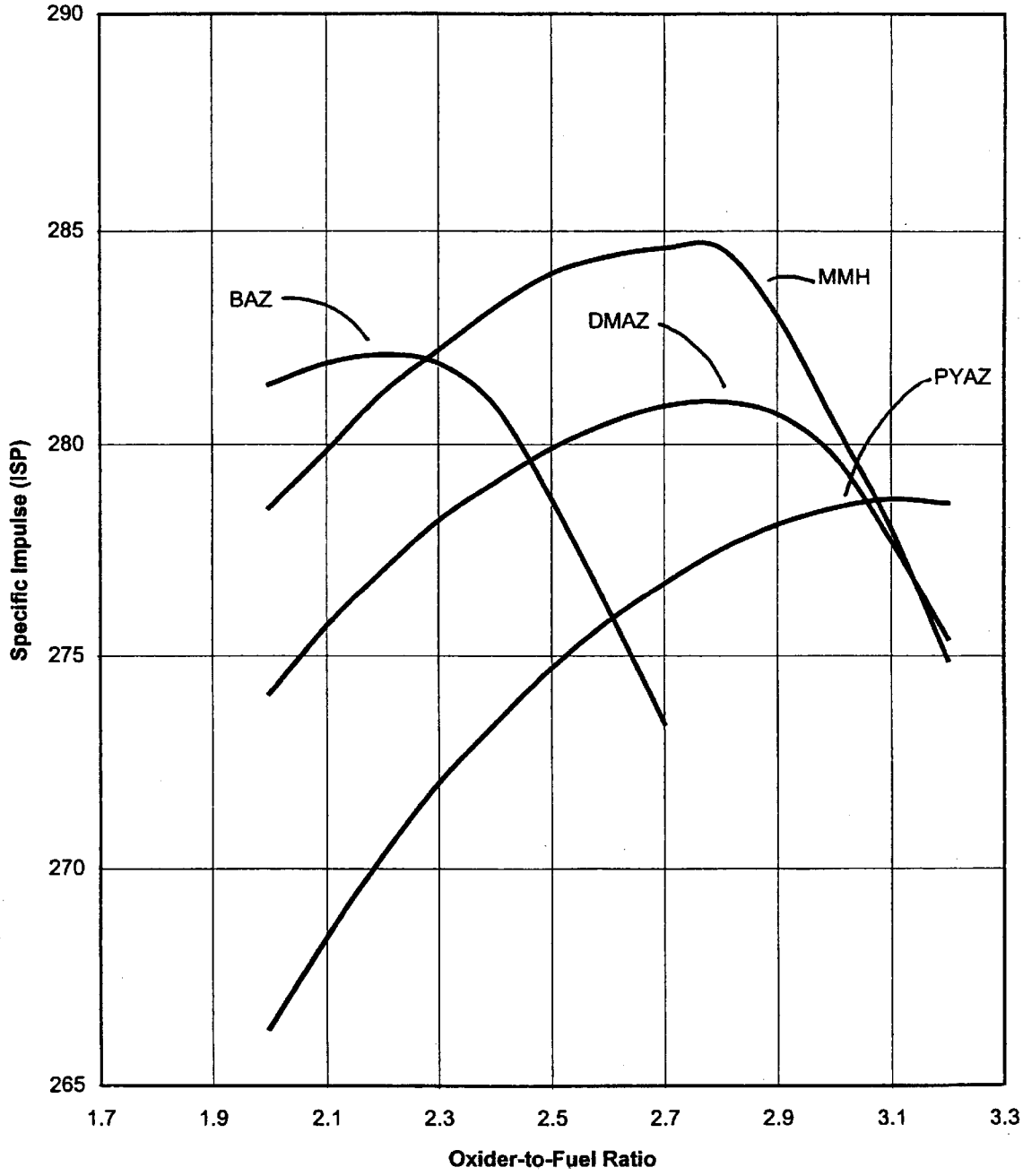
FIG. 1 of the Drawing depicts the Specific Impulse (ISP) plotted against Oxidizer-to-Fuel-Ratio for the tertiary amine azides: DMAZ, PYAZ, and BAZ and compared with MMH, a prior art fuel.

Where there exists bipropellant liquid or gel propulsion systems which use fuel gel as one of the components, (this would include NASA systems which uses nitrogen tetroxide and MMH for reactive control systems, and the Army and Airforce systems which use IRFNA and MMH for tacticals systems) DMAZ fuel could be used as a no-carcinogenic alternative to MMH. The tertiary amine azide gel can have from 0.5–10% gellant. The gellant can be silicon dioxide, clay, carbon, or any polymeric gellant. The tertiary amine azide gel can also include additives to improve the specific impulse and density impulse. These solid additives can include but would not be limited to amine-nitrate salts, quaternary ammonium salts, or triaminotrinitrobenzene. The formulation can contain 1%–90% solid additive, 98.5%–10% tertiary amine azide and 0.5%–10% gellant.

The tertiary amine azides used as hypergolic liquid or gel fuels in accordance with this invention have the requirement specified in Table 1 which are responsible for their superior fuel characteristics. The inclusion of an azide moeity into the tertiary amine molecule, improves the density and energy content. The effect that the azide moeity had on ignition delay was not expected. In the propulsion literature tertiary amines typically have a 20–30 millisecond ignition delay while the hydrazines have a 3–10 millisecond ignition delays. The presence of the azide moeity reduces the ignition delay of tertiary amines to the hydrazine levels. Testing of dimethylaminoethylazide (DMAZ) was tested and had a 6 millisecond ignition delay.

Calorimetry methods were used to determine the heats of formation of the tertiary amine azides. The freezing points have been verified using DSC (differential scanning calorimetry) method. The boiling points have been determined by observation. The heat of formation data has been used to determined the specific impulse and density specific impulse for each of the tertiary amines.

In existing bipropellant liquid or gel propulsion systems that use MMH as one of the components, a tertiary amine azide of this invention is used as a non-carcinogenic alternative to MMH. In the case of liquid systems the oxidizer can be inhibited red fuming nitric acid (IRFNA), nitrogen tetroxide, hydrogen peroxide, hydroxyl ammonium nitrate, or liquid oxygen. In the case of gels IRFNA, nitrogen tetroxide, hydrogen peroxide, or hydroxyl ammonium nitrate can be the oxidizers. In a gel formulation the tertiary amine azide gel can be 0.5%–10% gellant. The gellant can be silicon dioxide, clay, carbon, or any polymeric gellant. The tertiary amine azide gel can also include additives that could improve the specific impulse and density specific impulse. These solid additives could include but is not limited to carbon, aluminum, silicon, boron, tungsten, triaminotrinitro benzene or tetramethlyammoniumazide. The formulation can be 1%–90% solid additive, 98.5%–10% tertiary amine azide and 0.5%–10% gellant.

Table 1 (below) displays the physical and ballistic properties of the tertiary amine azide fuels. All of the fuels have at least the same boiling point to freezing point range as MM (monomethyl hydrazine). PYAZ has a considerably broader boiling point to freezing point range. All the densities are higher than MMH. The density specific impulse of the fuels is 1%–5% higher than MMH.

TABLE 1

| COMPOUND | UNITS | MMH | DMAZ | PYAZ | BAZ |
|---|---|---|---|---|---|
| Boiling Point | (° F.) | 188 | 276 | d-310 | d-316 |
| Freezing Point | (° F.) | −63 | −92 | −176 | −61 |
| Density | (g/cc) | 0.88 | 0.933 | 0.986 | 1.06 |
| Heat of Formation | (cal/g) | 276 | 580 | 520 | 828 |

d = Compound decomposes before boiling

In further reference to FIG. 1 of the drawing, this figure is a graph of the specific impulse (ISP) versus the oxidizer-to-fuel ratios of all the gel fuel formulations. The Specific Impulse (ISP) for the fuel gels has been calculated for a chamber pressure of 2000 psi. Each fuel formulation contains 98.5% IRFNA/1.5% hydroxylpropylcellulose as a gellant. The gel oxidizer used is a 95.5% IRPNA/4.5% silica gel formulation. MMH has a maximum ISP of 285 lbf*s/lbm at an oxidizer-to-fuel (O/F) ratio of 2.8. DMAZ has a maximum ISP of 281 lbf*s/lbm at an O/F ratio of 2.8. PYAZ has a maximum ISP of 279 lbf*sec/lbm at an O/F ratio of 3.1. BAZ has a maximum ISP of 282 lbf* sec/at an O/F ratio of 2.2.

Figure 2:
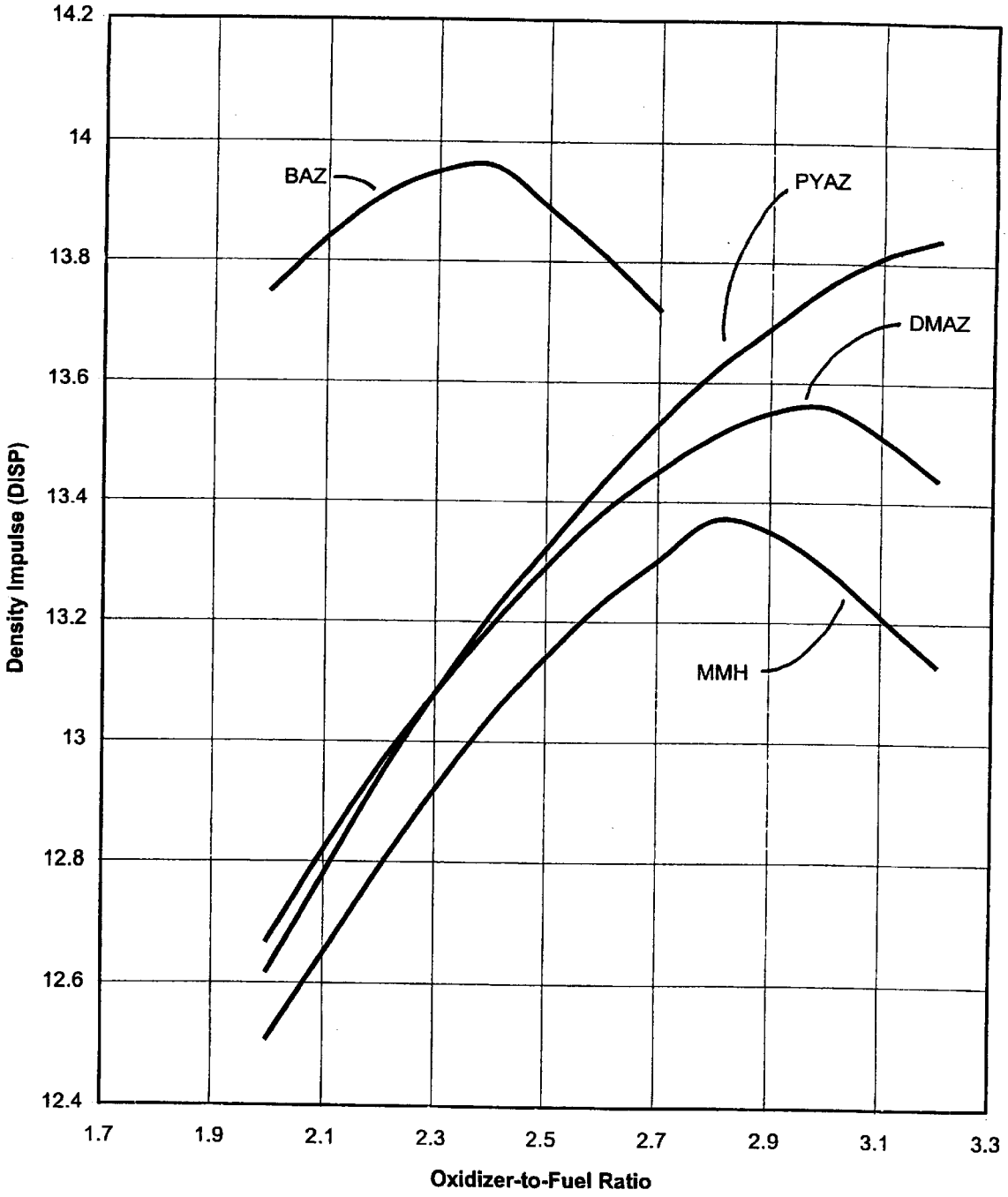
FIG. 2 of the Drawing depicts the Density Specific (DISP) plotted against Oxidizer-to-Fuel-Ratio for the tertiary amine azides: DMAZ, PYAZ, and BAZ and compared with MMH, a prior art fuel.

In further reference to FIG. 2 of the drawing, this figure is a graph of the density specific impulse (DISP) versus the oxidizer-to-fuel ratios of all the gel fuel formulations. The Density Specific Impulse (DISP) for the fuel gels has been calculated for a chamber pressure of 2000 psi. Each fuel formulation contains 98.5% IRFNA/1.5% hydroxylpropylcellulose as a gellant. The gel oxidizer used is a 95.5% IRFNA/4.5% silica gel formulation. MMH has a maximum DISP of 13.37 lbf*285 lbf*s/$_{in}^3$ at an O/F ratio of 2.8. DMAZ has a maximum DISP of 13.56 lbf* s/$_{in}^3$ at an O/F ratio of 3.0. PTAZ has a maximum DISP of 13.84 lbf*s/in$^3$ at an O/F ratio of 3.2. BAZ has a maximum DISP of 13.95 lbf*s/in$^3$ at an O/F ratio of 2.4.

The DMAZ has a specific impulse of 287 lbf sec/Ibm while the fuel gel has a specific impulse of 284 lbf sec/Ibm at 2000 psi at their respective optimum oxidizer-to-fuel ratios (O/F ratios). DMAZ has a maximum density impulse of 13.77 lbf sec/cubic inch while MMH has a maximum density impulse of 13.36 lbf sec/cubic inch. Therefore, DMAZ has a higher density impulse and specific impulse than MMH. DMAZ has been observed at −65° F. and no crystallization occurred at this condition. DMAZ has a boiling point above 165° F. so the DMAZ fuel gel meets the requirement of being a liquid from −65° F. to 165° F.

The gel can have 0.5%–10% gellant. The gellant can be selected from the group of gellant consisting of silicon dioxide, clay, carbon or any polymeric gellant. The DMAZ gel can also include additives for improving the specific impulse and density impulse. These additive can include but are not be limited to carbon, aluminum, silicon or boron. These additives can be in a formulation comprised of about 1%–70% boron, carbon, silicon or aluminum; 98.5%–20% DMAZ; and 0.5%–10% gellant.

In further reference to the drawings, FIG. 1 shows that the MMH fuel gel reaches its maximum specific impulse (284 lbf sec/Ibm) at an oxidizer/fuel ratio of 2.8 while the DMAZ fuel gel has a maximum specific impulse (287 lbf sec/Ibm) at an oxidizer/fuel ratio of 2.6.

FIG. 2 shows that the fuel gel reaches its maximum density impulse (13.36 lbf sec/cubic inch) at a oxidizer/fuel ratio of 2.8 while DMAZ fuel gel reaches its maximum density impulse (13.77 lbf sec/cubic inch) at an oxidizer/fuel ratio of 2.9.

The tertiary amine as hypergolic fuel can be employed with a common pressurization source which can be employed to expel an oxidizer into a combustion chamber as illustrated in commonly assigned U.S. Pat. No. 5,133,183. The described features can be within the spirit and scope of this invention.

It is to be understood, therefore, that while the present invention has been described by means of specific examples, it should not be limited thereto, for obvious variations and modifications may occur to those skilled in the art and such variations and modifications may be adhered to without departing from the spirit of the invention or the scope of the appended claims.

I claim:

1. A hypergolic liquid or gel fuel propulsion system comprising:

(i) a tertiary amine azide selected from the group of tertiary amine azides consisting of dimethylaminoethylazide, and pyrollidinylethylazide; and, (ii) an oxidizer selected from the group of oxidizers consisting of inhibited red fuming nitric acid, nitrogen tetroxide, hydrogen peroxide, hydroxyl ammonium nitrate, and liquid oxygen.

2. The hypergolic liquid or gel fuel propulsion system as defined in claim 1 wherein said tertiary amine azide is dimethylaminoethylazide in the form of a gel and having the following structure:

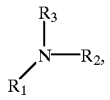

wherein $R_1$ = —$CH_3$
$R_2$ = —$CH_3$,
$R_3$ = —$CH_2CH_2N_3$

, and wherein said oxidizer is a gel of inhibited red fuming nitric acid.

3. The hypergolic liquid or gel fuel propulsion system as defined in claim 2 wherein said dimethylaminoethvlazide gel contains a solid additive selected from the group of solid additives consisting of amine-nitrate salts, quaternary ammonium salts, and triaminotrinitrobenzene, said dimethylamino ethylazide gel containing 1%–90% solid additives, 98.5%–10% said tertiary amine azide, and 0.5%–10% gellant selected from silicon dioxide, clay, carbon, and polymeric gellant.

4. The hypergolic liquid or gel fuel propulsion system as defined in claim 1 wherein said tertiary amine azide is pyrollidinylethylazide in the form of a gel and having the following structure:

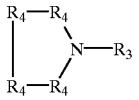

previously defined and wherein $R_4$ is —$CH_2$

, and wherein said oxidizer is a gel of inhibited red fuming nitric acid.

5. The pyrollidinylethylazide gel as defined in claim 4 wherein said gel contains a solid additive selected from the group of solid additives consisting of amine-nitrate salts, quaternary ammonium salts, and triaminotrinitrobenzene, said pyrollidinylethylazide gel containing 1%–90% solid additives, 98.5%–10% said tertiary amine azide, and 0.5%–10% gellant selected from silicon dioxide, clay, carbon, and polymeric gellant.

* * * * *